US006305335B1

(12) United States Patent
O'Toole

(10) Patent No.: US 6,305,335 B1
(45) Date of Patent: Oct. 23, 2001

(54) COMPACT LIGHT WEIGHT DIESEL ENGINE

(76) Inventor: Murray J. O'Toole, 2408 Via La Selva, Palos Verdes Estates, CA (US) 90274

( * ) Notice: Subject to any disclaimer, the term of this patent is extended or adjusted under 35 U.S.C. 154(b) by 0 days.

(21) Appl. No.: 09/634,878

(22) Filed: Aug. 7, 2000

Related U.S. Application Data

(60) Provisional application No. 60/151,948, filed on Sep. 1, 1999.

(51) Int. Cl.[7] ..... F02B 75/18

(52) U.S. Cl. ..... 123/56.3; 123/56.8

(58) Field of Search ..... 123/56.1, 56.2, 123/56.3, 56.4, 56.5, 56.6, 56.7, 56.8, 56.9

(56) References Cited

U.S. PATENT DOCUMENTS

| | | | |
|---|---|---|---|
| 1,565,184 | 12/1925 | Miller . | |
| 1,788,140 | 1/1931 | Woolson . | |
| 2,076,334 | 4/1937 | Burns . | |
| 2,994,188 | 8/1961 | Howard . | |
| 4,492,188 | 1/1985 | Palmer et al. | 123/56.8 |
| 4,635,590 | 1/1987 | Gerace | 123/56.2 |
| 5,031,581 | 7/1991 | Powell | 123/56.9 |
| 5,375,567 | 12/1994 | Lowi, Jr. | 123/56.8 |
| 5,507,253 | 4/1996 | Lowi, Jr. | 123/56.9 |
| 5,551,383 | 9/1996 | Novotny | 123/56.9 |
| 5,799,629 | 9/1998 | Lowi, Jr. | 123/56.8 |

*Primary Examiner*—Noah P. Kamen
(74) *Attorney, Agent, or Firm*—Miles & Stockbridge P.C.

(57) ABSTRACT

A compact light weight diesel cycle engine has a barrel arrangement of opposed-piston cylinders surrounding a power shaft that is rotationally supported on a plurality of transverse circular diaphragms attached at their perimeters to a sheet material shell. The cylinders are attached to and extend through at least some of the diaphragms to provide longitudinal structural members of the engine. Dual opposed cams are mounted on the power shaft at opposite ends of the cylinders and are coupled to the pistons by connecting rods. The cams are constructed to convert linear movement of the pistons to rotational movement of the power drive shaft. Toward the end of a power stroke, high pressure air is admitted to the cylinders through inlet ports that are opened before exhaust ports are opened. Heat exchangers use exhaust gas to pre-heat the air. Special fuel injectors use intersecting fuel jets to provide a high level of fuel atomization, turbulence, and dispersion in the cylinders. Special ignitors provide both a glow plug and a spark plug.

17 Claims, 13 Drawing Sheets

COMPACT LIGHT WEIGHT DIESEL ENGINE

CROSS REFERENCE TO RELATED APPLICATION

This application takes the benefit of Provisional Application 60/151,948 filed Sep. 1, 1999 and incorporated herein by reference.

BACKGROUND OF THE INVENTION

This invention is concerned with internal combustion engines, particularly two stroke diesel cycle engines of the type having a barrel arrangement of cylinders with opposed pistons and using dual cams to convert linear piston movement to rotational movement of a central power shaft. While this general type of engine is well known, the present invention provides improvements and advantages that have not been attained heretofore.

BRIEF DESCRIPTION OF THE INVENTION

A principal object of the invention is to provide a compact light weight two stroke internal combustion engine, particularly an engine using the diesel cycle, that can serve as a static or propulsive power plant and that is friendly to the environment.

In a preferred embodiment, a barrel arrangement of cylinders (like a revolver gun) serves as a main structural component of the engine, the cylinders being attached to and extending through transverse diaphragms that support a central power shaft rotationally and that are attached at their perimeters to a shell or casing forming an engine enclosure. Dual opposed cams at opposite ends of the cylinders convert linear movement of the pistons to rotational movement of the power shaft. The cams preferably have a "bicycle wheel" construction in which a hub on the power shaft is connected to a configured rim by a plurality of spokes.

In a preferred embodiment of the invention, inlet ports of the cylinders are opened toward the end of a power stroke, to admit high pressure air before exhaust ports are opened, in order to promote more complete combustion and efficient exhaust gas scavenging. Heat exchangers use the exhaust gas to preheat the high pressure air admitted to the cylinders.

Also, in a preferred embodiment, special fuel injectors are used that cause fuel jets to intersect and thereby to provide better fuel atomization, turbulence, and combustion.

Further in accordance with a preferred embodiment, special ignitors are used that combine a glow plug and a spark plug.

BRIEF DESCRIPTION OF THE DRAWINGS

The invention will be further described in conjunction with the accompanying drawings, which illustrate preferred and exemplary (best mode) embodiments, and wherein.

DETAILED DESCRIPTION OF THE INVENTION

Figure 1:
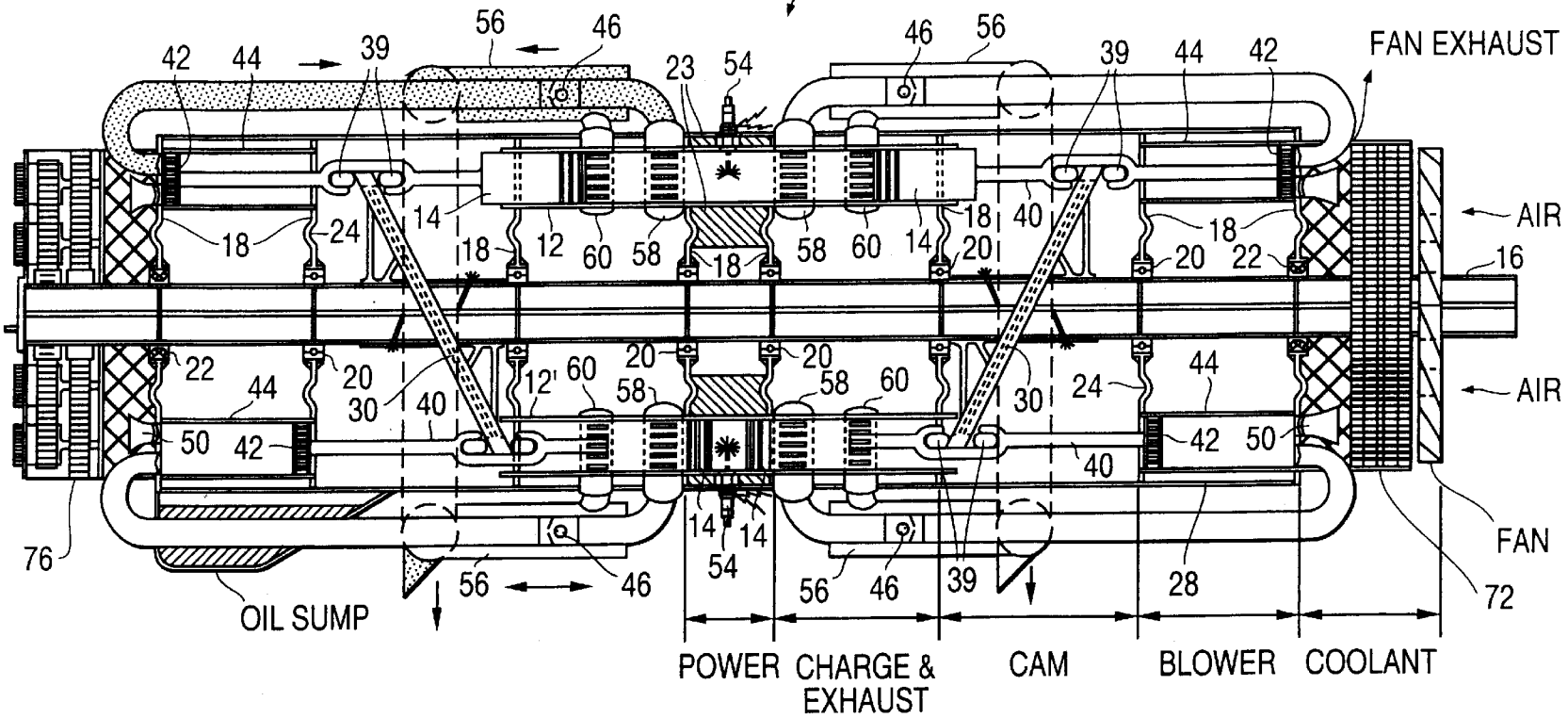
FIG. 1 is a diagrammatic longitudinal sectional view of an internal combustion engine in accordance with the invention.
Figure 1B:
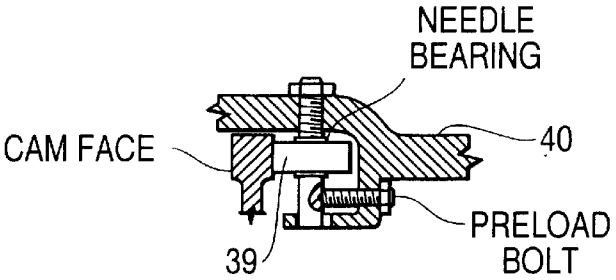
FIG. 1B is a fragmentary sectional view showing a cam follower that may be employed in the invention.
Figure 1C:
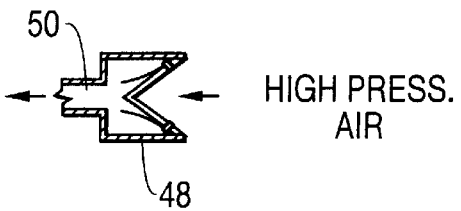
FIG. 1C is a fragmentary sectional view showing a reed valve that may be employed in the invention.
Figure 1A:
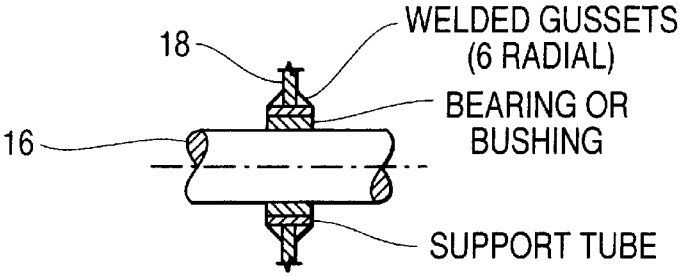
FIG. 1A is a fragmentary sectional view showing a shaft bearing detail.
Figure 2:
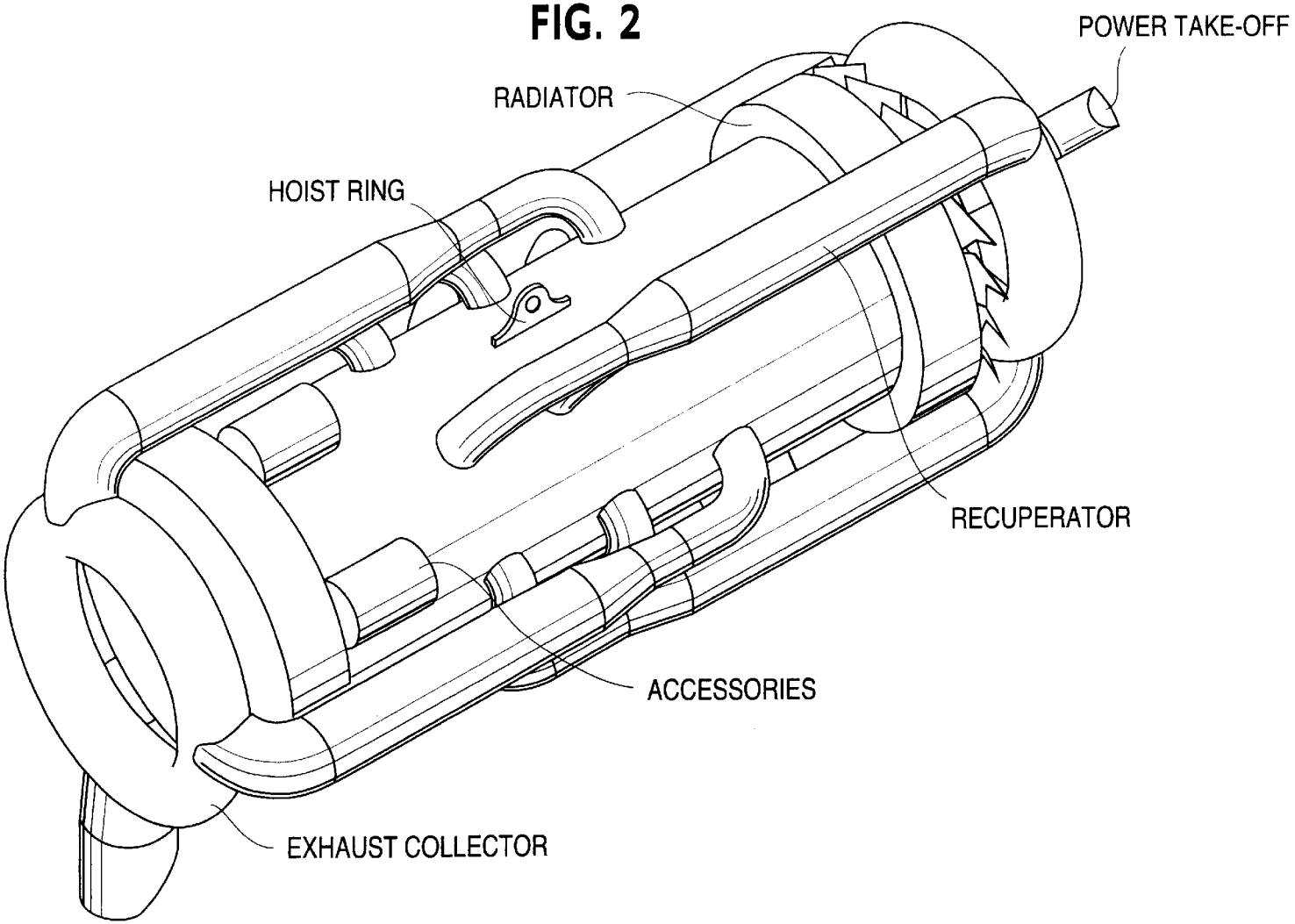
FIG. 2 is a perspective external view of an engine in accordance with the invention, differing in some respects from the engine shown in FIG. 1.
Figure 3:
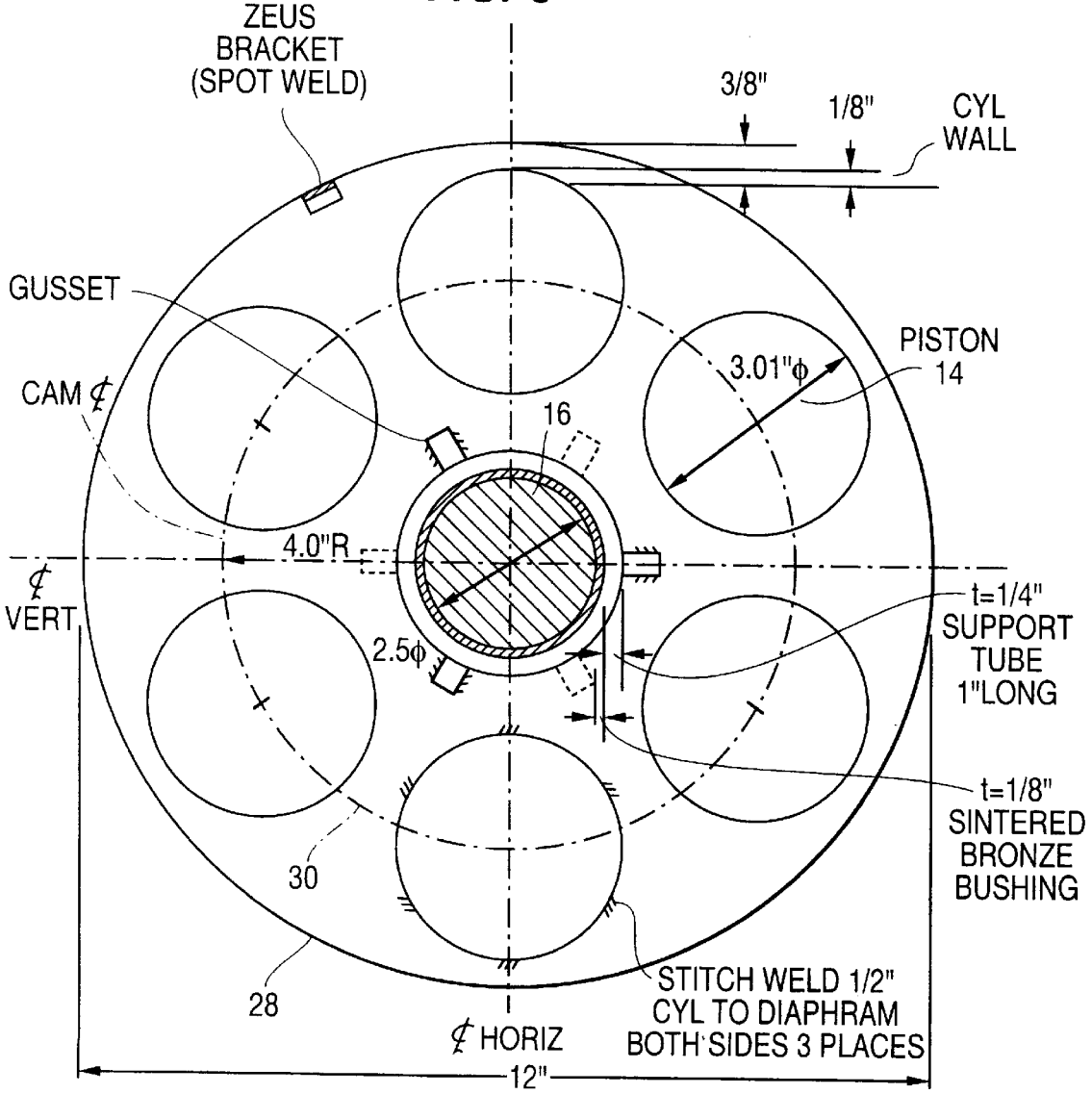
FIG. 3 is a diagrammatic cross-sectional view showing a cylinder and shaft arrangement.
Figure 4:
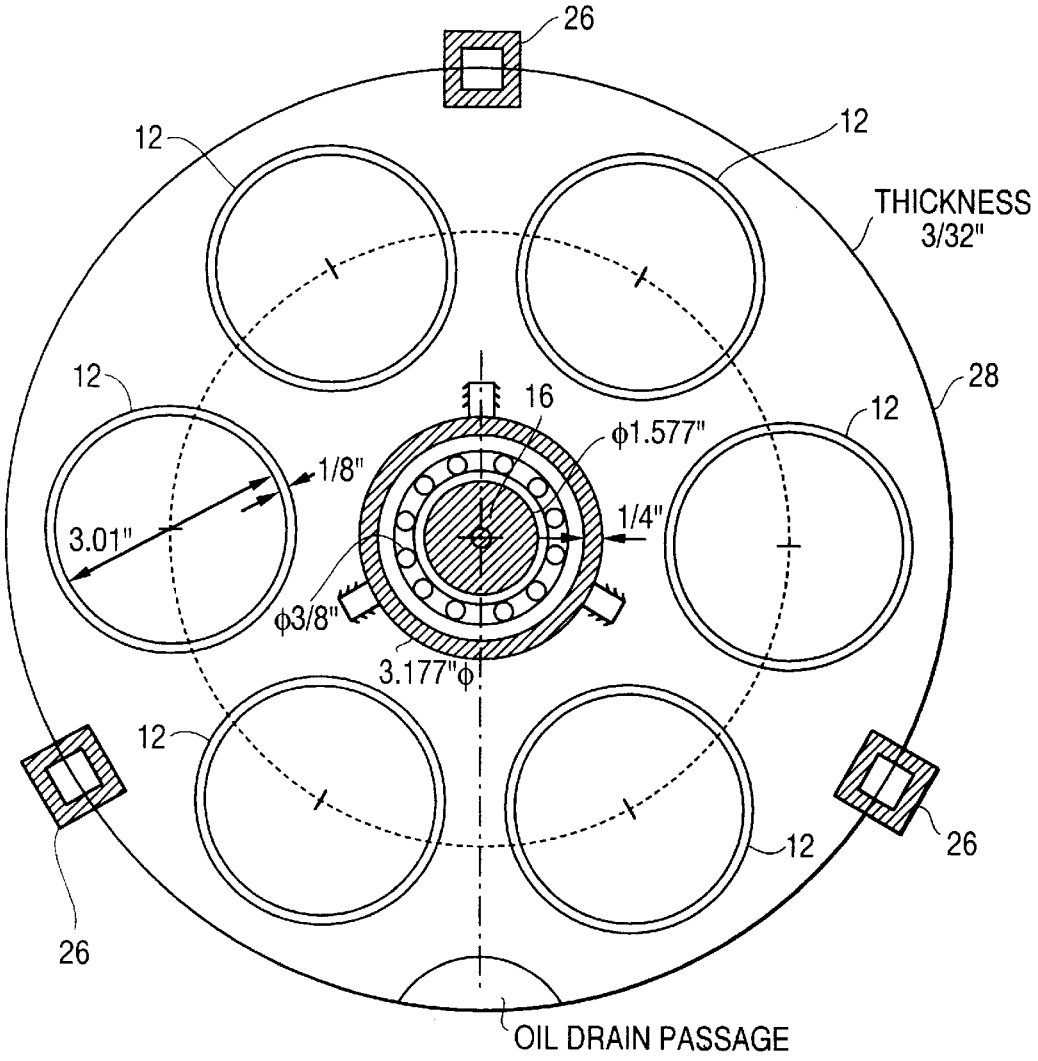
FIG. 4 is a diagrammatic cross-sectional view showing an arrangement of cylinders, power shaft, support diagram and longitudinal structural members.

In the embodiment of a two stroke diesel cycle engine 10 as show in FIGS. 1–3, six cylinders 12 with opposed pistons 14 are disposed in a barrel arrangement equally spaced circumferentially about a central power shaft (main shaft) 16. Thin circular diaphragms 18 spaced along the power shaft perpendicular thereto support the power shaft for rotational movement on bearings 20. A shaft bearing detail is shown in FIG. 1A. The outermost diaphragms have thrust bearings 22 to accommodate any axial movement of the drive shaft. Double thrust bearings are used at the front of the engine for engine (and propeller) loads and a single thrust bearing at the rear of the engine for accessory and engine loads.

The cylinders are attached to and extend through several of the diaphragms and constitute main longitudinal structural components (stringers) of the engine. The diaphragms can be attached to the cylinders by spot welded tabs, but the innermost diaphragms are preferably attached to the cylinders throughout the perimeters of the cylinders to retain coolant 23 in a head portion of the cylinders. The diaphragms constitute bulkheads of the engine and have circular corrugations 24 which allow for radial and lateral growth (good strain relief). The use of thin circular bulkheads to which the cylinders are rigidly attached as stringers gives a strong, rigid, and very light weight structure. The bulkheads are preferably formed of marageing Hi Temp steel so as to have the same coefficient of thermal expansion as the cylinders to which they are rigidly attached. The bulkheads are tied together by longitudinal beams or tubes 26. Side beams carry the engine mounts, while a top beam carries lift or hoist rings for handling the engine. Perimeters of the bulkheads are attached to a casing or shell 28 constituting an outer enclosure of the engine.

Two opposed cams 30 for converting linear movement of the pistons to rotational movement of the power shaft are mounted on the power shaft at opposite ends of the cylinders. Torque can be varied by changing the radius of the cams and thus the basic radius of the engine. The power output is proportional to the number of cylinders used. An advantage of the dual cams is that the thrust reaction on the cams is taken out in tension on the sturdy power shaft, relieving the requirement for heavier shaft thrust bearings.

Figure 5A:
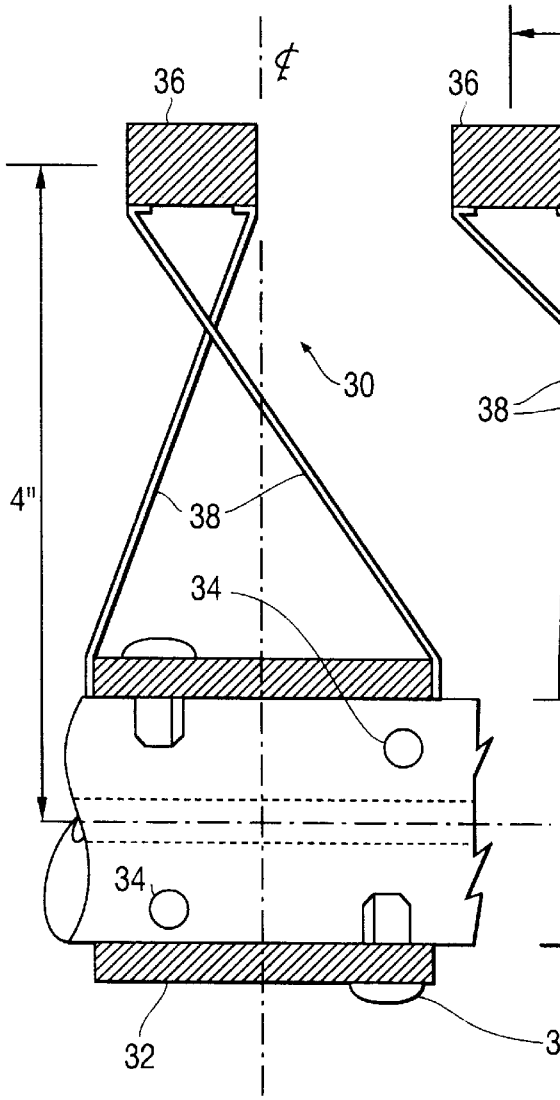
FIGS. 5A and 5B are fragmentary cross-sectional views showing the construction of preferred cams employed in the invention.
Figure 5B:
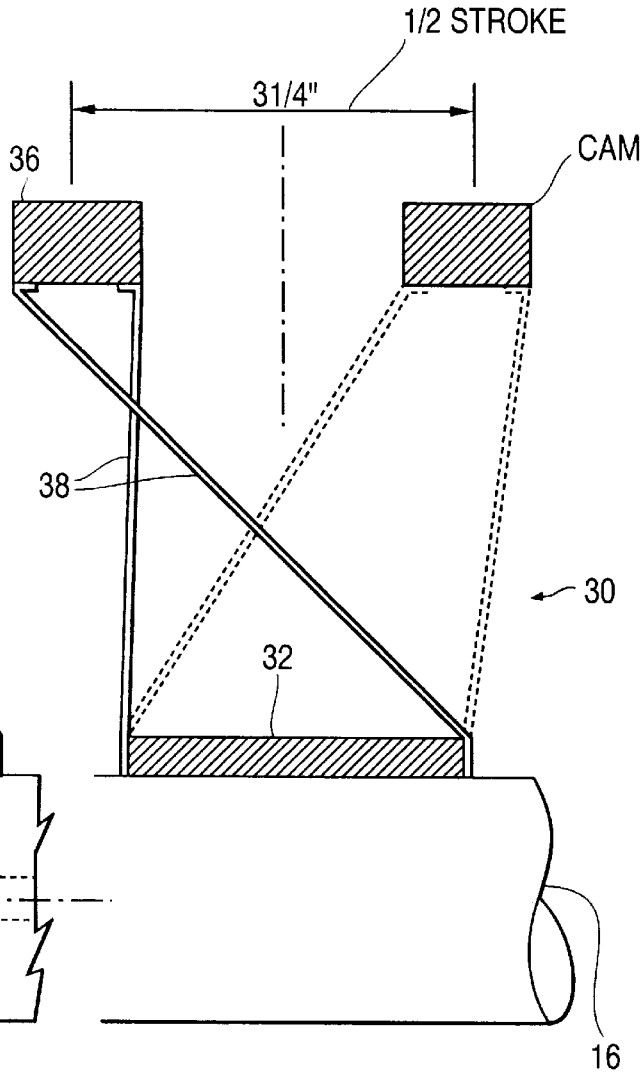

As shown in FIGS. 5A and 5B, each cam is preferably constructed like a bicycle wheel with a hub 32 that is attached to the power shaft 16 by shear pins 34, such as spiral spring pins, (for cam replacement and/or indexing) and a rim 36 connected to the hub by a series of spokes 38. The spokes are preferably streamlined rods. The rim undulates with respect to the central plane of the cam, preferably in accordance with a double sine wave pattern (see FIGS. 6–7). The construction of the cams reduces weight and windage.

As shown in FIGS. 1 and 1A, the cams are coupled by cam followers 39 to connecting rods 40 extending from the pistons. A metal cam follower coated with friction material to minimize slipping against a metal cam face is preferred. The cam followers are mounted on needle bearings packed with a high temperature grease and sealed. Each cam follower is preferably adjustable for installation and preloading.

The power shaft is preferably made of a high strength carbon steel. The basic structure (cylinders, diaphragms, stringers, cams) employs a special marageing steel which maintains its strength at high temperatures. This contributes to light weight, allowing hot parts to be of thinner gauge. The pistons are preferably aluminum, and the outer enclosure of the engine is preferably aluminum sheet attached by fasteners that allow for easy removal to assist access to the internal parts of the engine.

Figure 14:
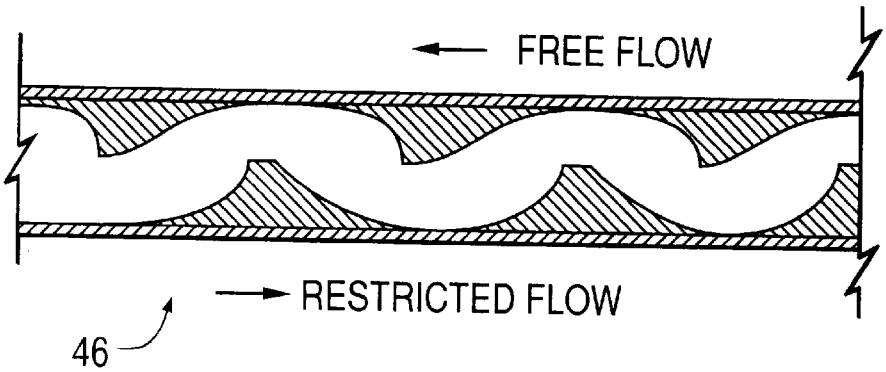
FIG. 14 is a diagrammatic cross-sectional view showing a Tesla type check valve that may be employed in the invention.

In the embodiment shown in FIG. 1 the connecting rods 40 are connected to pistons 42 in cylinders 44 of a blower (compressor) for compressing air that is supplied to the main cylinders of the engine through check valves 46. In the preferred embodiment, the check valves are of the Tesla type, shown diagrammatically in FIG. 14. Reed valves 48, one of which is shown in FIG. 1C, are provided at air inlets 50 of the cylinders of the blower. To simplify the construction of the engine, the blower (compressor) arrangement shown in FIG. 1 can be deleted in favor of a turbocharger driven by exhaust gas flow. A turbocharger, with pressure ratio of two or more, for example, requires less horsepower from the engine.

Figure 8:
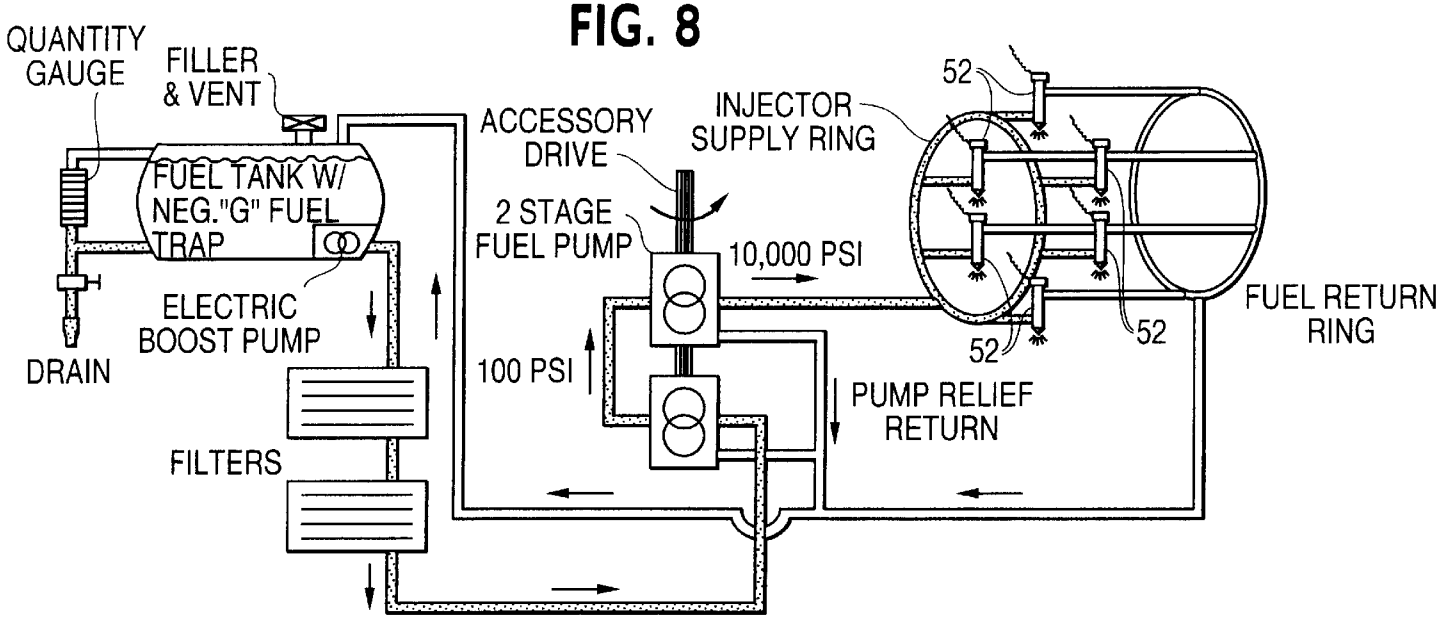
FIG. 8 is a diagram of a fuel system that may be employed in the invention.
Figure 9:
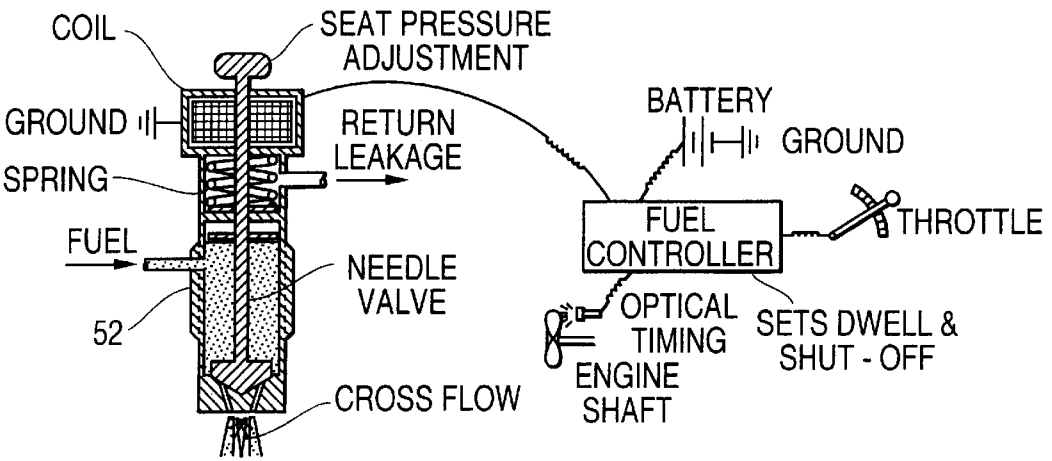
FIG. 9 is a combined sectional and diagrammatic view of a typical fuel injector that may be employed in the invention, together with associated parts of the fuel system.

A typical fuel system that may be employed in the engine is shown in FIG. 8. The fuel system includes electronic fuel injectors 52, a typical injector being shown in FIG. 9 along with associated components. Each injector is disposed at a central head portion of an associated cylinder. In the preferred form, each injector has a plurality of cross-flow nozzles oriented to cause jets of emitted fuel to intersect and to impinge upon each other under very high pressure (high velocity) to provide a high level of atomization, turbulence, and dispersion between opposed piston heads, which are preferably flat. The amount of fuel is controlled by computer in response to throttle setting (power desired). This controls the time the nozzles are open, and the cam position is sensed to provide the timing for injection and burn. Excess fuel is returned to a tank.

Figure 10:
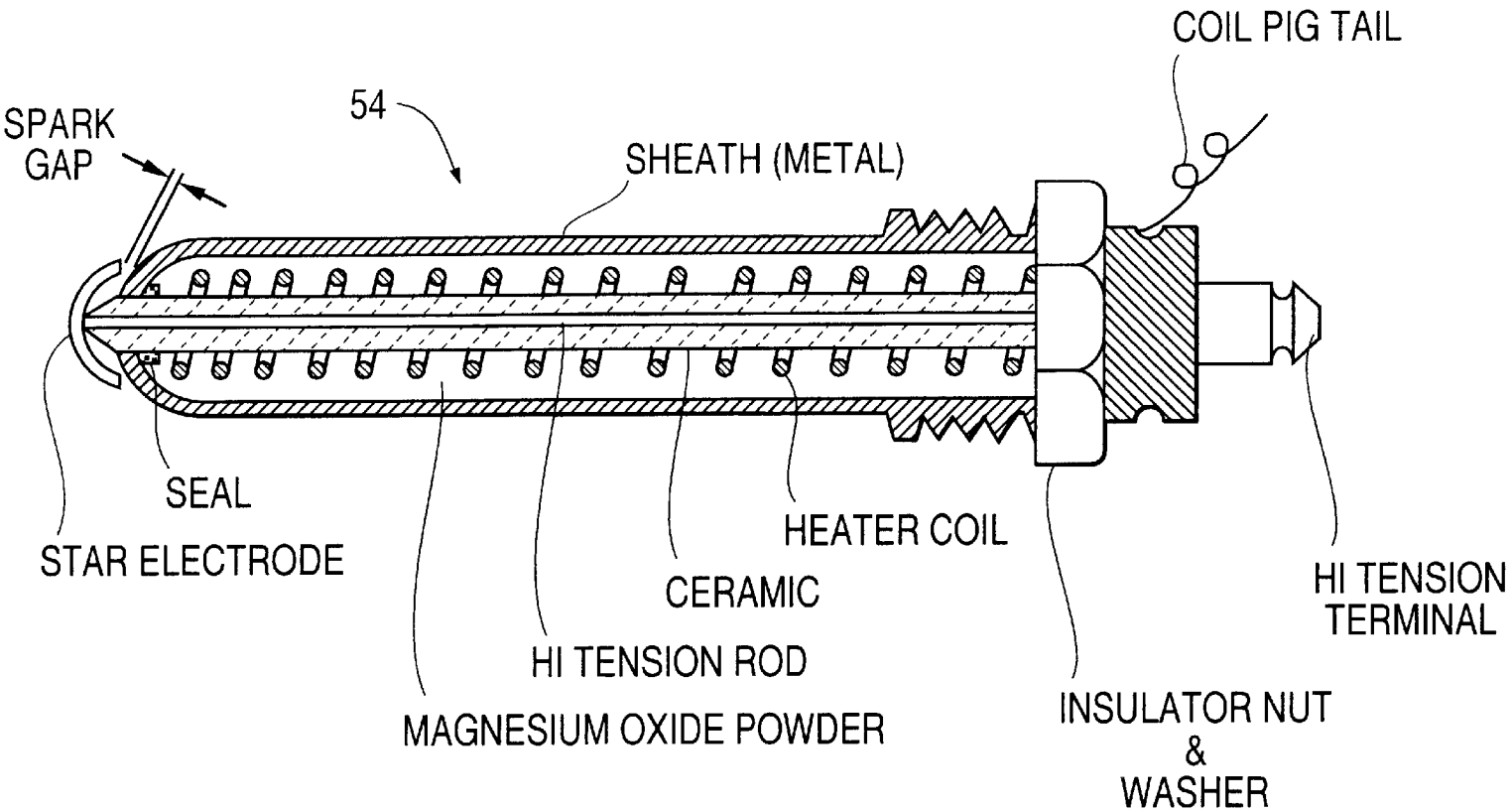
FIG. 10 is a sectional view showing a preferred form of ignitor that may be employed in the invention.

At the head portion, each cylinder is also provided with an ignitor 54 (FIG. 10) that is preferably constructed to provide both a glow plug and a spark plug. When the engine is started, the spark plug of the ignitor is in operation to provide for cold starts, and the heating coil of the ignitor is also in operation to heat the glow plug. After a short run, the spark plug is shut off, and the engine operates on the powered glow plug. After sufficient time, the heating coil is shut off, and the engine operates on the residual heat of the glow plug without drawing current. This arrangement allows quick cold starts, minimizing environmental concerns.

The fuel injectors are not shown in FIG. 1 (to avoid confusion in the illustration) but are disposed on corresponding cylinders at positions opposite to the ignitors.

The preferred embodiment of the invention shown in FIG. 1 has a plurality of heat exchangers 56 (recuperators), two for each cylinder, that are used to pre-heat compressed charge air, thereby lowering the adiabatic compression ratio required to bring the fuel and air mixture to auto ignition temperature. The use of the heat exchangers permits extra volume between the pistons, providing better fuel dispersion across the face of the pistons. Each heat exchanger is located in a portion of an intake manifold adjacent to the corresponding cylinder and is connected to air inlet and exhaust ports 58 and 60 of the corresponding cylinder.

Figure 13A:
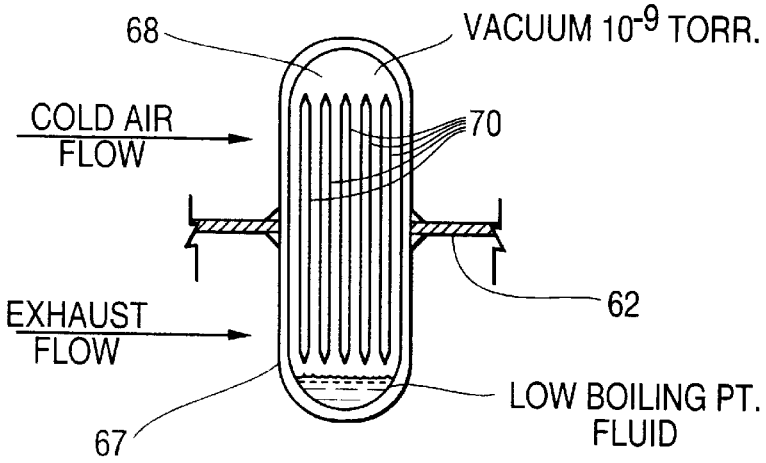
FIG. 13A is a diagrammatic cross-sectional view of a heat tube, one of a plurality of the heat tubes being employed in the heat exchanger of FIG. 12.
Figure 13B:
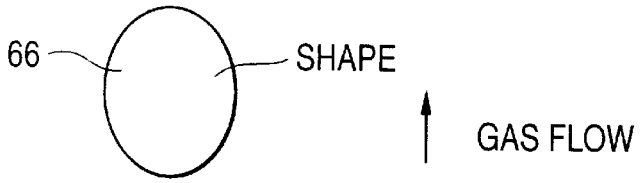
FIG. 13B is a diagram showing the outline of the heat tube relative to gas flow past the heat tube.
Figure 12:
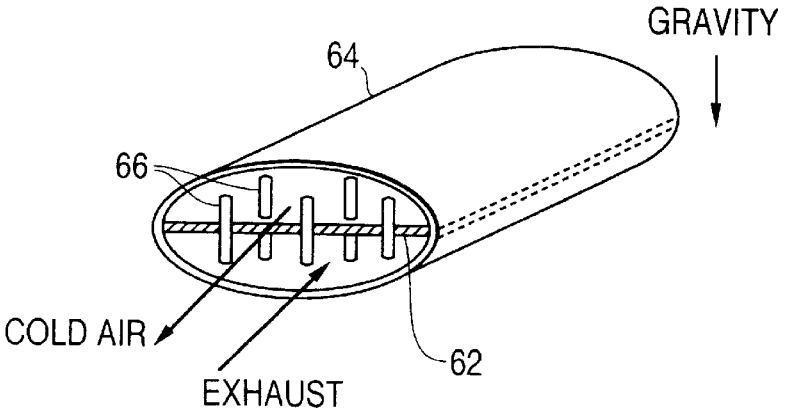
FIG. 12 is a perspective view of a heat exchanger that may be employed in the invention.

Details of a preferred form of heat exchanger are shown in FIGS. 12, 13A and 13B. A longitudinal baffle 62 divides a flow pipe 64 of the heat exchanger into cold air and exhaust flow paths and is traversed by a plurality of conventional heat tubes 66 arranged in staggered rows. Each heat tube, which has an outer configuration shown in FIG. 13B, contains a low boiling point fluid in a boiler section 67 below the baffle and has a condenser section 68 above the baffle. The inner surface of each heat tube has a plurality of grooves 70 that facilitate return of condensed fluid to the boiler section by gravity flow.

Figure 11:
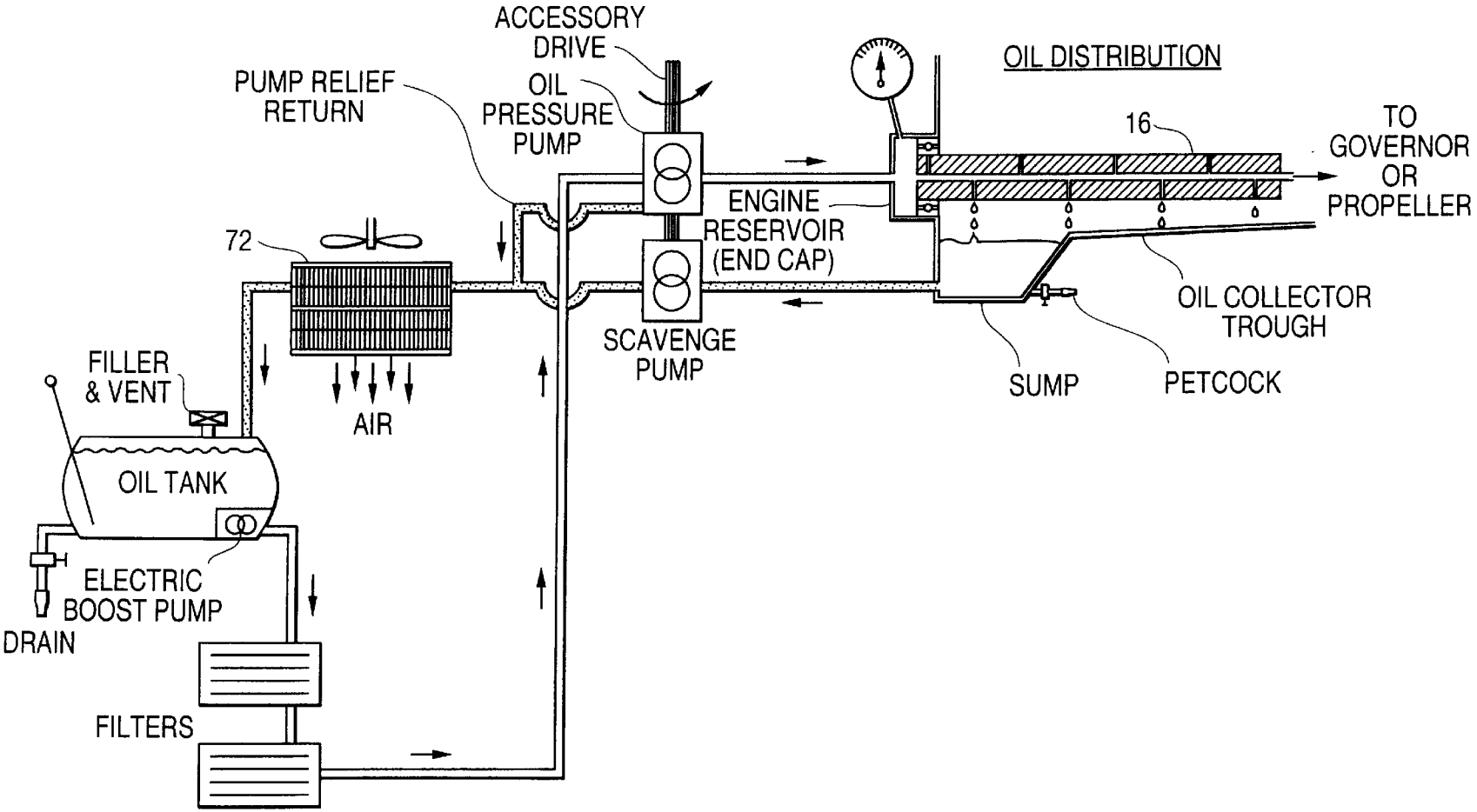
FIG. 11 is a diagram of a lubrication system that may be employed in the invention.

FIG. 11 shows a lubrication system that may be used in the engine of the invention. Lubrication oil is provided under pressure (80–90 psi) to a small reservoir at an end of the power shaft. Oil flows through passages in the power shaft, spraying the thrust bearings and the rotational bearings at each cylinder support diaphragm. Excess oil drips into a sloping oil pan at the bottom of the engine and flows by gravity into a sump, from which the oil is returned to an oil tank by a scavenge pump. Oil is also sprayed on the cam faces. Grease lubricates the cam followers. Top end lubrication for the pistons is provided by a synthetic type oil spray into the air induction system.

Figure 16:
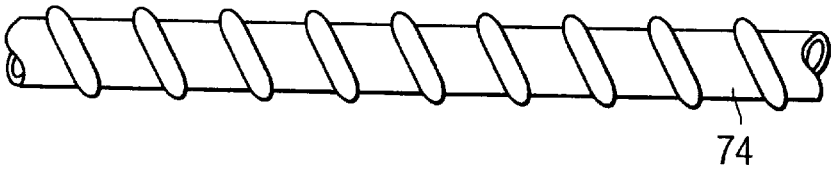
FIG. 16 is a fragmentary plan view showing a turbulence tube employed in the radiator.
Figure 15:
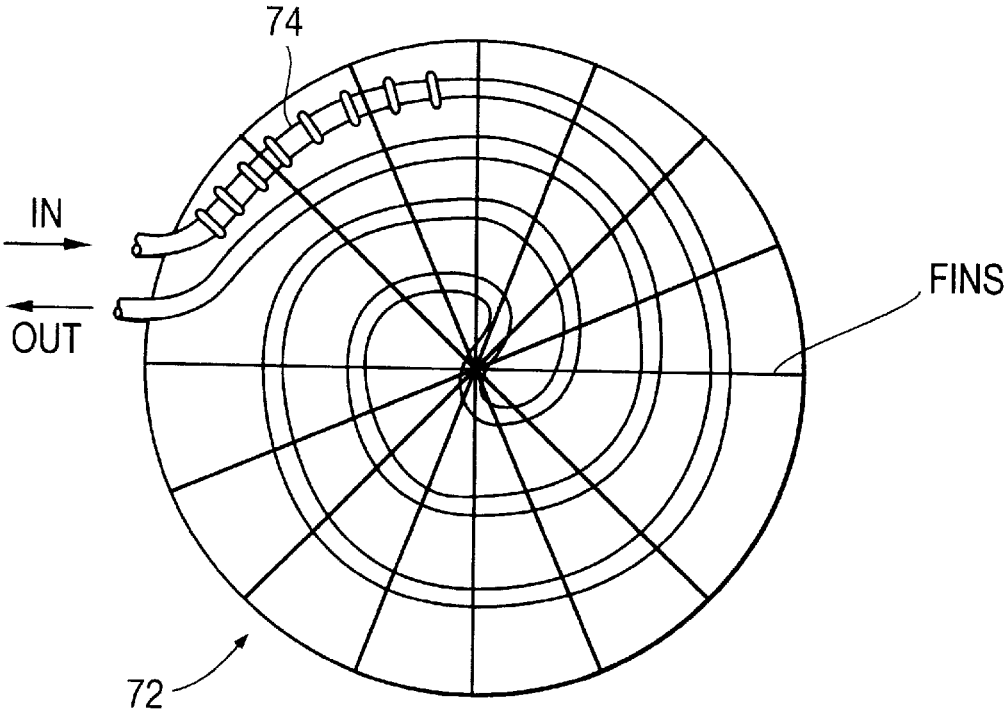
FIG. 15 is a diagrammatic end view of a radiator that may be employed in the invention.

In the preferred embodiment, a two-section radiator 72 is provided at the front of the engine, one section for cooling the lubrication oil and the other for cooling the cylinder head coolant. A preferred form of radiator is shown in FIG. 15 and comprises a finned turbulence tube 74 (a portion of which is shown diagrammatically in FIG. 16) spirally wound to conform to the circular engine diameter.

An automatic electrically controlled cooling fan is provided to maintain fluid temperatures, but may be eliminated when the engine is used for an aircraft or marine propulsion system. In some applications, ram air may be sufficient to avoid the need for the cooling fan. Incidentally, the flow path of oil through the power shaft can extend to a propeller for use in a conventional blade pitch adjustment mechanism. All pipe runs of the engine are preferably coated on the outside by a temperature barrier of zirconium oxide, which retains the heat in the gas in the pipe and reduces heat radiation to the engine casing or nacelle.

Figure 1D:
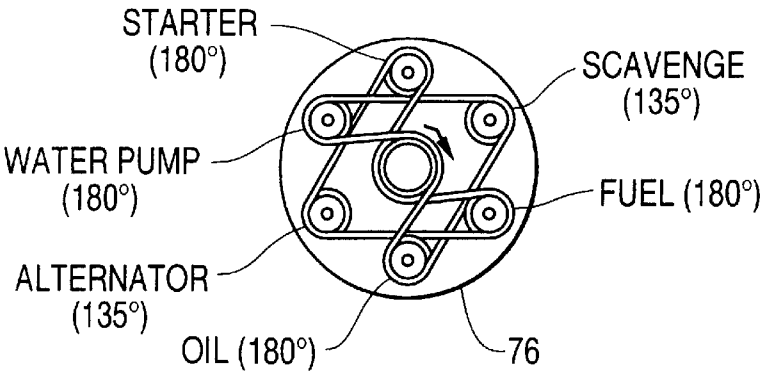
FIG. 1D is a diagram showing an accessory belt drive arrangement that may be employed in the invention.

In the preferred embodiment of FIGS. 1 and 1D there is a gear box and an accessory belt drive 76 at the rear of the engine. The accessory belt drive may be used to drive the fuel pump, oil pump, and the scavenge pump shown in FIGS. 9 and 11, and also used to drive an alternator, starter, and water pump, not shown. The accessories can be placed wherever convenient space is available.

Figure 6:
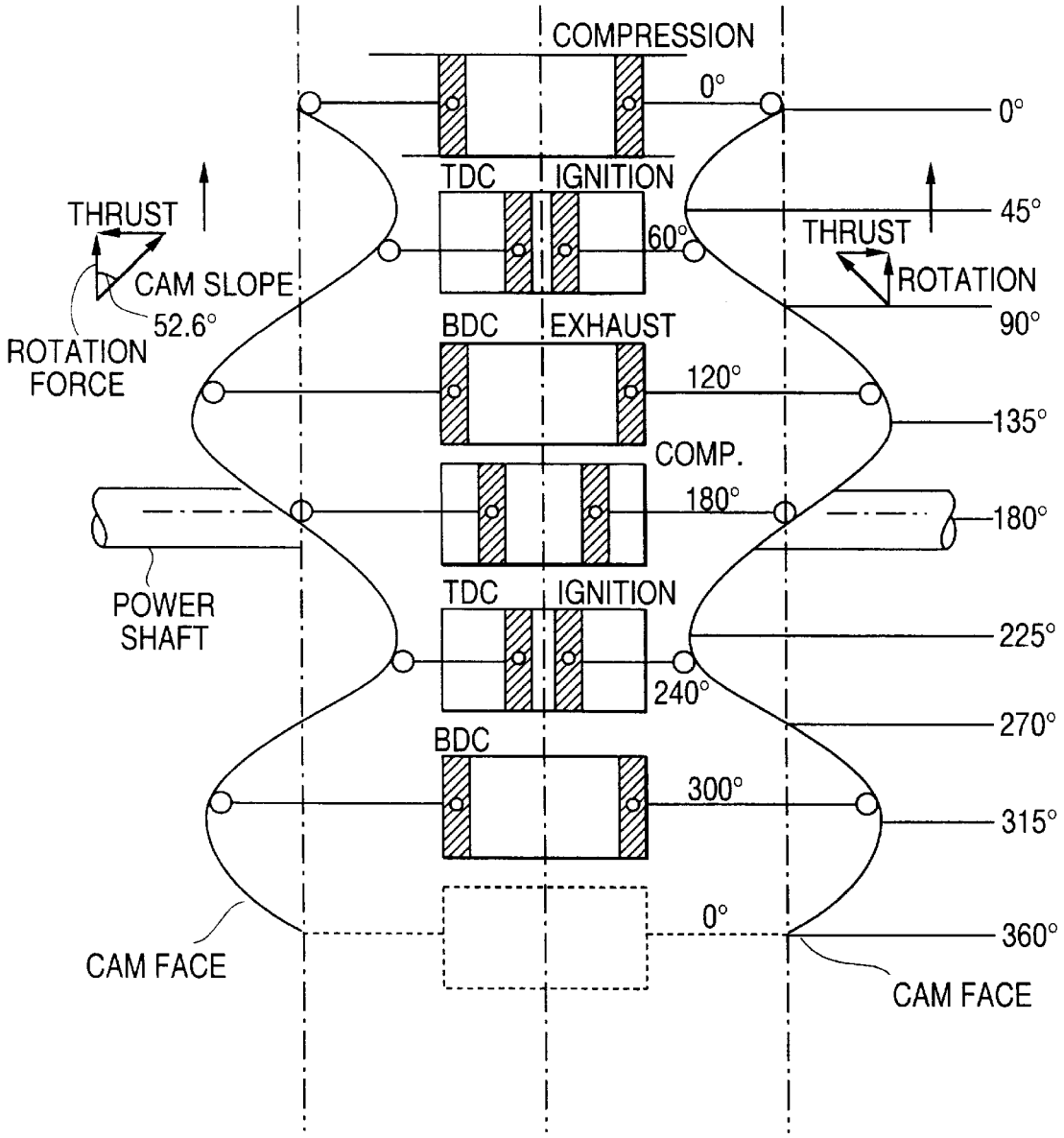
FIG. 6 is a diagram showing unrolled cam faces and the relation of the cam faces and cam followers on connecting rods extending from dual pistons, at successive portions of a two stroke diesel cycle.
Figure 7:
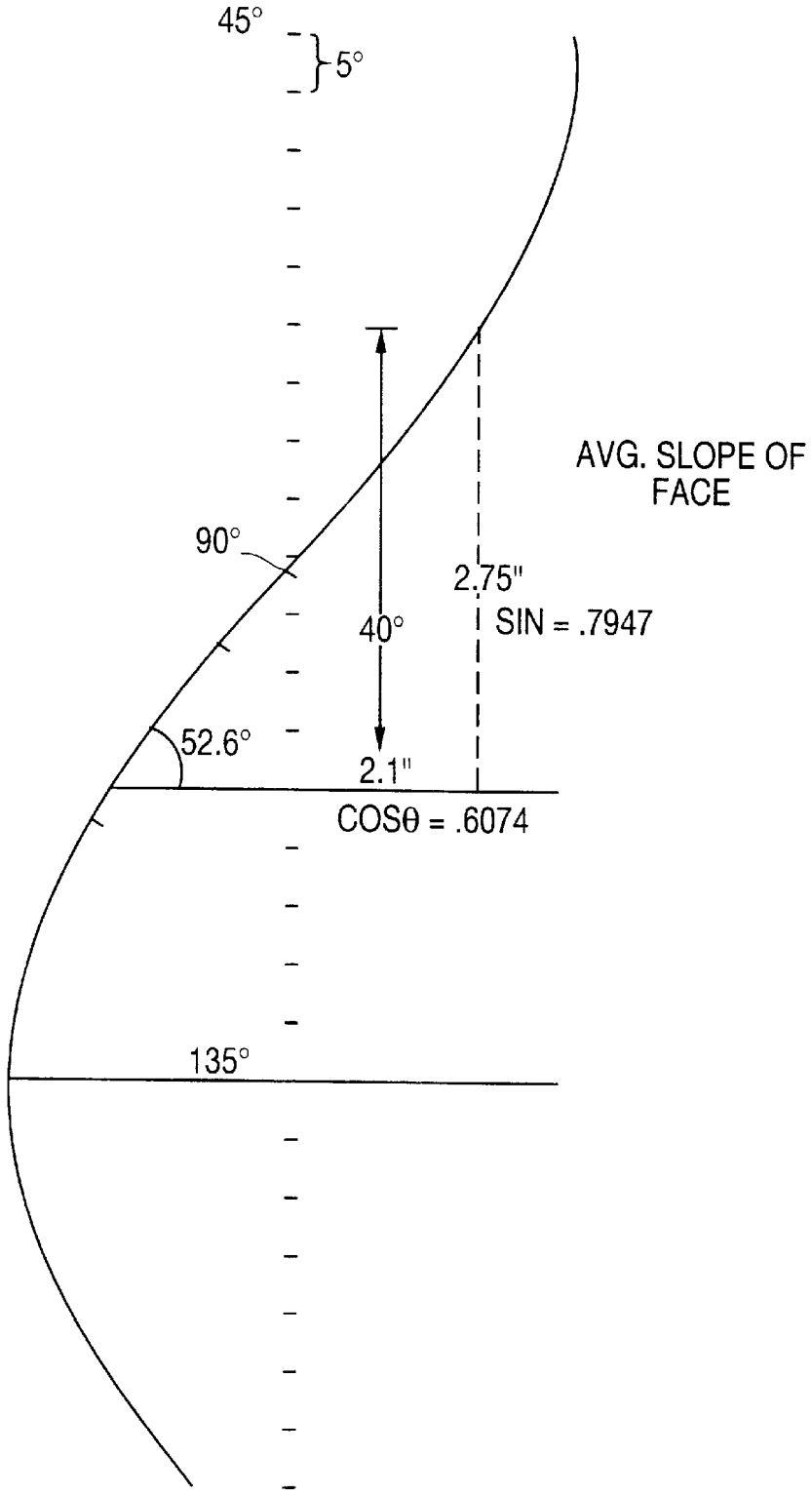
FIG. 7 is a diagram showing the average slope of a cam face.

FIG. 6 shows the operation of the engine diagrammatically. There are two firings (power strokes) in each cylinder for each revolution of the cams and power shaft. Consequently, there are twenty-four power strokes per revolution in the illustrated embodiment of the engine.

To provide uniflow (unidirectional flow), the air inlets to each cylinder are located closer to the head portion of each cylinder than the exhaust ports, which are located near the bottom dead center (BDC) of the piston stroke. (The terms "bottom", "down", "up", and "top" are used herein as in conventional internal combustion engine terminology.) This arrangement opens each air inlet port as the corresponding piston is moving down on its power stroke, adding pressurized air to burn residual fuel in the cylinder and to provide extra power until the exhaust port is opened by the piston travel. Then the pressurized air assists movement of the exhaust gas through a heat exchanger. The dwell time at the bottom of the stroke is sufficient to provide necessary scavenging.

On the up stroke, each piston shuts off the exhaust port, and the uniflow is reversed, with the compressed, preheated charge of air being further compressed by the piston travel. At top dead center a charge is very near auto ignition temperature.

FIG. 2 shows the external appearance of an engine of the invention having a configuration somewhat different from that shown in FIG. 1.

While preferred embodiments of the invention have been shown and described, it will be apparent to those skilled in the art that changes can be made without departing from the principles and spirit of the invention, the scope of which is defined in the appended claims.

The invention claimed is:

1. A compact light weight internal combustion engine comprising:

a plurality of opposed-piston cylinders in a barrel arrangement about a central power shaft;

a plurality of diaphragms spaced along the length of the power shaft transversely thereto and having bearings supporting the power shaft for rotation, the cylinders extending through and being attached to at least some of the diaphragms;

a pair of opposed cams attached to the power shaft at opposite ends of the cylinders, each piston having a connecting rod coupled to one of the cams by a cam follower, each cam being constructed to convert linear movement of the pistons to rotational movement of the power shaft; and a shell surrounding the perimeters of the diaphragms and attached thereto as an enclosure for the engine.

2. An internal combustion engine according to claim 1, wherein each cylinder has, on each side of a head portion thereof, an inlet port and an exhaust port disposed to be opened and closed by a corresponding piston within the cylinder, the inlet ports being connected to a source of compressed air and being closer than the exhaust ports to the head portion of the cylinders, whereby during a power stroke the inlet ports are opened to admit high pressure air to the cylinders before the exhaust ports are opened, and during a compression stroke the exhaust ports are closed before the inlet ports are closed.

3. An internal combustion engine according to claim 2, further comprising heat exchangers using exhaust gas from the exhaust ports to heat compressed air supplied to the inlet ports.

4. An internal combustion engine according to claim 3, wherein each heat exchanger comprises a pipe divided by a longitudinal baffle traversed by a plurality of heat tubes extending through the baffle between an exhaust side of the baffle and an air inlet side of the baffle, each heat tube containing a low boiling point fluid in a boiler section of the heat tube at the exhaust side of the baffle and having a condenser section at the air inlet side of the baffle, the heat tubes being oriented so that the fluid therein returns from the condenser section to the boiler section by gravity flow.

5. An internal combustion engine according to claim 2, wherein each inlet port is connected to the source of compressed air via a check valve constructed to prevent back flow from the inlet port to the source.

6. An internal combustion engine according to claim 5, wherein the check valve is a Tesla type.

7. An internal combustion engine according to claim 2, wherein the compressed air is provided by a blower.

8. An internal combustion engine according to claim 1, wherein circular diaphragm corrugations accommodate stress-related movement of parts of the engine.

9. An internal combustion engine according to claim 1, wherein each cam defines a double sine wave configuration.

10. An internal combustion engine according to claim 1, wherein each cam comprises a hub attached to the power shaft and an undulating rim attached to the hub by a plurality of spokes.

11. An internal combustion engine according to claim 1, wherein each cylinder has a fuel injector at a head portion thereof.

12. An internal combustion engine according to claim 11, wherein each fuel injector has cross-flow nozzles oriented to cause intersection of fuel jets and atomization of fuel jets emitted from the fuel injector.

13. An internal combustion engine according to claim 1, wherein each cylinder has an ignitor at a head portion thereof, the ignitor being constructed to provide both a glow plug and a spark plug.

14. An internal combustion engine according to claim 1, wherein the engine is a two stroke diesel cycle engine.

15. An internal combustion engine according to claim 1, wherein the engine has a radiator at one end thereof and an accessory drive at the opposite end thereof.

16. An internal combustion engine according to claim 15, wherein the engine has a lubrication system including flow paths for oil in the power shaft and flow paths through the radiator.

17. An internal combustion engine according to claim 15, wherein the radiator comprises a spiral arrangement of finned turbulence tubing.

* * * * *